United States Patent [19]

Johnson et al.

[11] Patent Number: 4,895,239

[45] Date of Patent: Jan. 23, 1990

[54] CURVED ESCALATOR WITH FIXED CENTER CONSTANT RADIUS PATH OF TRAVEL

[75] Inventors: Gerald E. Johnson, Farmington; Frank M. Sansevero, West Hartford; Dat Nguyen, New Britain, all of Conn.

[73] Assignee: Otis Elevator Company, Farmington, Conn.

[21] Appl. No.: 328,924

[22] Filed: Mar. 27, 1989

[51] Int. Cl.[4] ..... B66B 21/02

[52] U.S. Cl. ..... 198/328; 198/778; 198/831

[58] Field of Search ..... 198/328, 334, 778, 831, 198/845

[56] References Cited

U.S. PATENT DOCUMENTS

| | | | |
|---|---|---|---|
| 617,779 | 1/1899 | Seeberger . | |
| 685,019 | 10/1901 | Venn . | |
| 723,325 | 3/1903 | Souder . | |
| 727,720 | 5/1903 | Venn . | |
| 782,009 | 2/1905 | Dodge . | |
| 967,710 | 8/1910 | Bennett . | |
| 984,495 | 2/1911 | Seeberger . | |
| 984,858 | 2/1911 | Seeberger . | |
| 999,885 | 8/1911 | Seeberger . | |
| 1,023,443 | 4/1912 | Seeberger . | |
| 2,695,094 | 11/1954 | Riley . | |
| 2,823,785 | 2/1958 | Hefti . | |
| 3,878,931 | 4/1975 | Luna . | |
| 4,662,502 | 5/1987 | Nakatami | 198/328 |
| 4,726,460 | 2/1988 | Otomo | 198/328 |
| 4,730,717 | 3/1988 | Sugita | 198/328 |
| 4,739,870 | 4/1988 | Saito | 198/328 |
| 4,746,000 | 5/1988 | Nakatami et al. | 198/328 |

FOREIGN PATENT DOCUMENTS

| | | |
|---|---|---|
| 3441845A1 | 6/1985 | Fed. Rep. of Germany . |
| 48-25559 | 7/1973 | Japan . |
| 58-220077 | 12/1983 | Japan . |
| 292641 | 6/1928 | United Kingdom . |

*Primary Examiner*—Robert J. Spar
*Assistant Examiner*—D. Glenn Dayoan
*Attorney, Agent, or Firm*—William W. Jones

[57] ABSTRACT

An escalator is provided with a curved path of travel from its entry to its exit landings. The path of travel of the escalator steps as seen in plan is a curve having a fixed center and a constant radius from landing to landing. In elevation, each landing portion will be disposed in vertically spaced horizontal planes, and there will be a medial constant slope ascending or descending portion. Interconnecting each landing portion with the constant slope portion will be entry and exit transitional curved portions of varying slope as seen in the elevational view. To enable the steps to traverse the curved path successfully, the effective length of at least one of the step chains is varied at different points along the path of travel of the escalator.

5 Claims, 4 Drawing Sheets

CURVED ESCALATOR WITH FIXED CENTER CONSTANT RADIUS PATH OF TRAVEL

DESCRIPTION

1. Technical Field

This invention relates to a curved escalator construction, and more particularly to a curved escalator having a path of travel defined by a fixed center, constant radius arc when viewed in plan.

2. Background Art

Escalators which follow a curved path of travel from entry landing to exit landing are generally known in the prior art. There are two general approaches which have been taken in the prior art to designing an operable curved escalator. One approach involves the use of a path of travel which, in plan, is defined by an arc having varying radii of curvature and emanating from a shifting center. The other approach involves the use of a path of travel which, in plan, is defined by an arc of constant radius struck from a fixed center.

Patent publications which relate to the aforesaid first approach include: Japanese Patent Publication 48-25559 of July, 1973; German Patent Publication 3,441,845, June 13, 1985; U.S. Pat. No. 4,662,502, Nakatani et al, granted May 5, 1987; and U.S. Pat. No. 4,746,000, Nakatani et al, granted May 24, 1988.

Patent publications which relate to the aforesaid second approach include: U.S. Pat. Nos. 685,019, Oct. 22, 1901; 723,325, Mar. 24, 12, 1903; 782,009, Feb. 7, 1905; 967,710, Aug. 16, 1910; 2,695,094, Nov. 23, 1954; 2,823,785, Feb. 18, 1958; 3,878,931, April 22, 1975; 4,726,460, Feb. 23, 1988; 4,730,717, Mar. 15, 1988; 4,739,870, Apr. 26, 1988; British Patent No. 292,641, June 22, 1928; and Japanese Patent Disclosure No. 58-220077, 1983.

Japanese Patent Disclosure No. 58-220077, dated Dec. 21, 1983 discloses a curved escalator which has a constant radius, fixed center arcuate path of travel when viewed in plan. When the treads of the escalator move from the horizontal landing to the constant slope intermediate zone, they are properly repositioned by accelerating and decelerating their inside edges in the transition zones adjacent the landings. The differential movement of the inside tread edges is accomplished with pivoting links which interconnect the step axles of adjacent steps and which are joined at pivot points provided with rollers that traverse a track. The step axles also have rollers at their inside ends which travel over another track vertically spaced from the link roller track. The position of the inside edges of the steps is varied in the transition zone by varying the vertical distance between the inside step axle roller track and the link roller track beneath it. The links lengthen in the constant slope portion of the escalator and shorten in the horizontal landing and turn around zones. The steps are engaged by driving chains which connect to the step axles only in the constant slope zone where the position of the steps relative to each other remains constant. The drive chains do not contact the step axles in the transition, landing, or turn around zones. Varying the position of the inside edge of the steps requires that the connecting links be shortened in the horizontal and turn around zones of the escalator, and the use of two separate tracks for the inside step axle roller and for the adjustment link rollers, requires that the adjustment links will always be skew throughout the entire path of travel of the escalator. The use of two separate axle roller and link roller tracks also requires that the drive housing and tread reverse sprockets be vertically elongated.

Charles D. Seeberger was a turn-of-the-century inventor who obtained U.S. Pat. Nos. 617,778, granted Jan. 17, 1899; 617,779, granted Jan. 17, 1899; 984,495, granted Feb. 14, 1911; 984,858, granted Feb. 21, 1911; and 999,885, granted Aug. 8, 1911, which all relate to curved escalators. The 617,779 patent discusses the need to shorten and lengthen step chains in a curved escalator having a path of travel which has portions with different radii. The step chains are formed with segments which are threadedly connected to each other. The segments are rotated by a pinion mechanism to unscrew, or tighten the threaded connections whereby the chain is lengthened or shortened when necessary. The 984,495 patent states that a curved escalator with a fixed radius, constant center cannot have both ends of adjacent step axles connected to each other by links of fixed length. A scissor connection is then made between succeeding axles, and a slight adjustment of this connection is made when the steps move from the curved horizontal track section to the inclined curved section of the track. The adjustment is described at Page 3, line 119 to Page 4, line 28 of the patent. The 999,885 patent describes a curved escalator having its steps connected together at their inner and outer edges, with the outer edge connection being of constant length, and the inner edge connection being variable by reason of adjustable links.

DISCLOSURE OF INVENTION

This invention relates to a step chain and track assembly for use in a curved or spiral escalator of the type having a fixed center, constant radius arcuate path of travel when viewed in plan. The assembly of this invention takes into account that in the escalator of the type specified, the steps, as they pass from the horizontal landing entry area into and through the entry transitional area to the constant slope area, will have to pivot with respect to each other in order to have their tread surfaces remain horizontal. This pivoting movement is accomplished by moving the outer side of the steps at a different angular velocity than the inner side of the steps as the latter move through the entry transition zone and through the constant slope zone when viewed in plan. In the exit transition zone, the differential movement of the inner and outer sides of the steps is reversed so that the steps then pivot back to their original orientation relative to each other. Thus the velocities of the steps and their angular positions will vary at different locations along the path of movement thereof. In order to allow the pivotal step movement without binding the steps together, the step risers will be formed with a modified conical configuration, the details or specifics of which will be determined by the radius of curvature of the path of travel of the escalator, and the size of the step.

The differential velocity and pivotal movement of the steps is accomplished in the assembly of this invention preferably by changing the effective length of the outer step chain without changing the length of its individual links. It should be noted that the actual length of the step chain is not altered, but only its effective length is changed. The step chains consist of a plurality of links which are pivotably connected together and which are also connected to the roller axles on the steps. Each of the chain link pivot connections carries a chain roller, as will be described in greater detail hereinafter. The step roller axles carry rotating rollers which move on tracks mounted beneath the steps, in a known manner. In the assembly of this invention, the outermost of the tracks along which the step rollers move is a simple track, which in the constant slope portion of the escalator path and the transition and landing zones consists of only one common track along which all of the chain rollers, including the step axle rollers, move. In the constant slope portion of the escalator path, the outer step chain will have a first effective shortened length, and thus the adjacent step axles will be separated by a first shortened predetermined distance. In the horizontal and turn around portions of the escalator path the effective length of the chain increases. Thus the distance between the step axles will be larger in the landing and turn around zones.

The effective length of the outer step chain is shortened in the transition and constant slope zones by rigidly affixing one link on the outer step chain to each outer step axle. The remaining chain links which interconnect the step axle links with the next adjacent step axles in the escalator are all flexibly connected together. Thus these interconnecting links can flex or pivot with respect to each other, with respect to the fixed step axle links, and with respect to the next adjacent step axles. As a result of forming the outer step chain with a combination of fixed and flexible links, when the steps move through the transition and constant slope zones, the end of each intermediate link which is connected to a fixed step axle link will be lifted upwardly away from the outer track. This will cause a plurality of upwardly directed kinks to form the outer step chain in the inclined zones of the escalator. These kinks will decrease or disappear in the horizontal landing zones. If the fixed step axle links are all parallel to the step treads, then the outer step chain will be straight, as viewed in elevation, as it moves through the landing zones. This will allow the outer step chain to be turned around by a relatively conventional turn around sprocket.

In accordance with this invention, in the entry transition zone, i.e., the transition zone between the entry landing and the constant slope portion of the escalator, the effective length of the outside chain will shorten, and the reverse will happen in the exit transition zone which connects the constant slope portion of the escalator with the exit landing.

It is therefore an object of this invention to provide an escalator-driving step chain and track assembly for use in a curved escalator having a fixed center and constant radius path of travel when viewed in plan.

It is an additional object of this invention to provide an assembly of the character described wherein the steps of the escalator are pivoted with respect to each other as the steps move to or from horizontal landing zones from or to a constant slope intermediate zone.

It is a further object of this invention to provide an assembly of the character described wherein the pivotal movement of the steps is accompanied by a change in the angular velocity of the outer edges of the steps when viewed in plan.

It is another object of this invention to provide an assembly of the character described wherein the effective length of the outer step chain is changed as the steps move between landing zones and the intermediate constant slope zone so as to change the distance between step axles on adjacent steps on the escalator.

It is yet an additional object of this invention to provide an assembly of the character described wherein the effective length of the step chain is changed by selectively kinking the chain.

These and other objects and advantages of the invention will become more readily apparent from the following detailed description of the invention when taken in conjunction with the accompanying drawings in which:

BEST MODE FOR CARRYING OUT THE INVENTION

Figure 1:
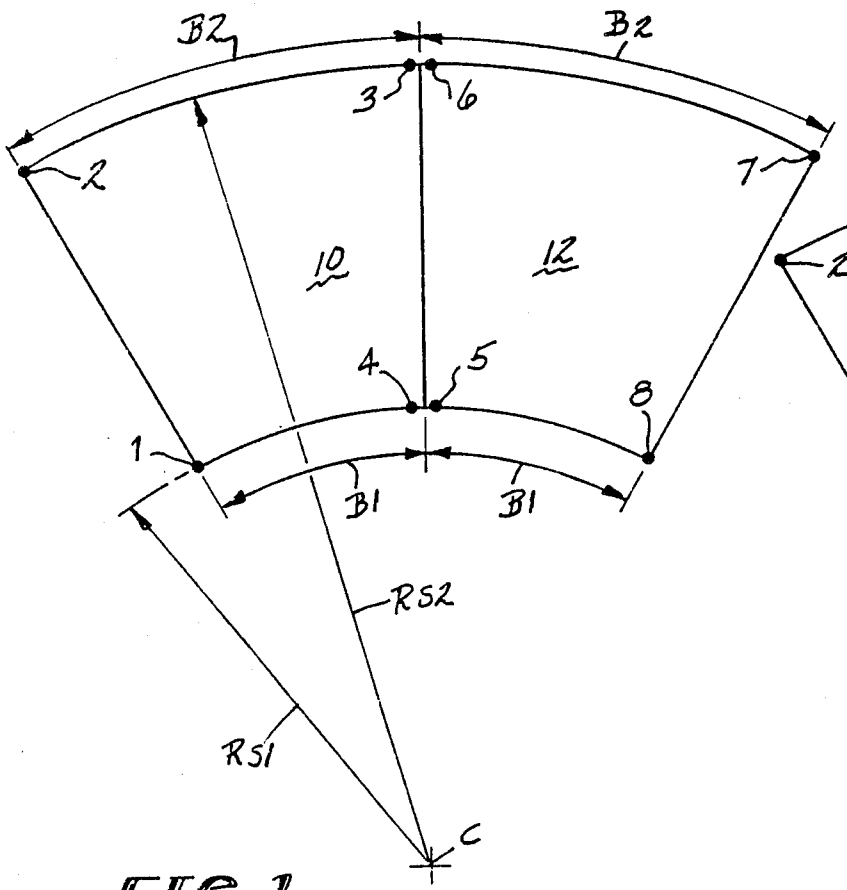
FIG. 1 is a plan view of the steps of the escalator as they appear in the horizontal landing zones of the escalator.

Referring now to FIG. 1, there are shown two steps 10 and 12 on the escalator as they would appear in plan view looking down on the treads in one of the horizontal landing zones. The steps 10, and 12 have constant arcuate inner sides of radius RS1 along which points 1, 4, 5 and 8 lie, and constant arcuate outer sides of radius RS2 along which points 2, 3, 6 and 7 lie. The radii RS1 and RS2 are struck from a fixed center C. The inner step chain has an incremental length B1 for each step 10 and 12, and the outer step chain has an incremental length B2 for each step 10 and 12.

Figure 2:
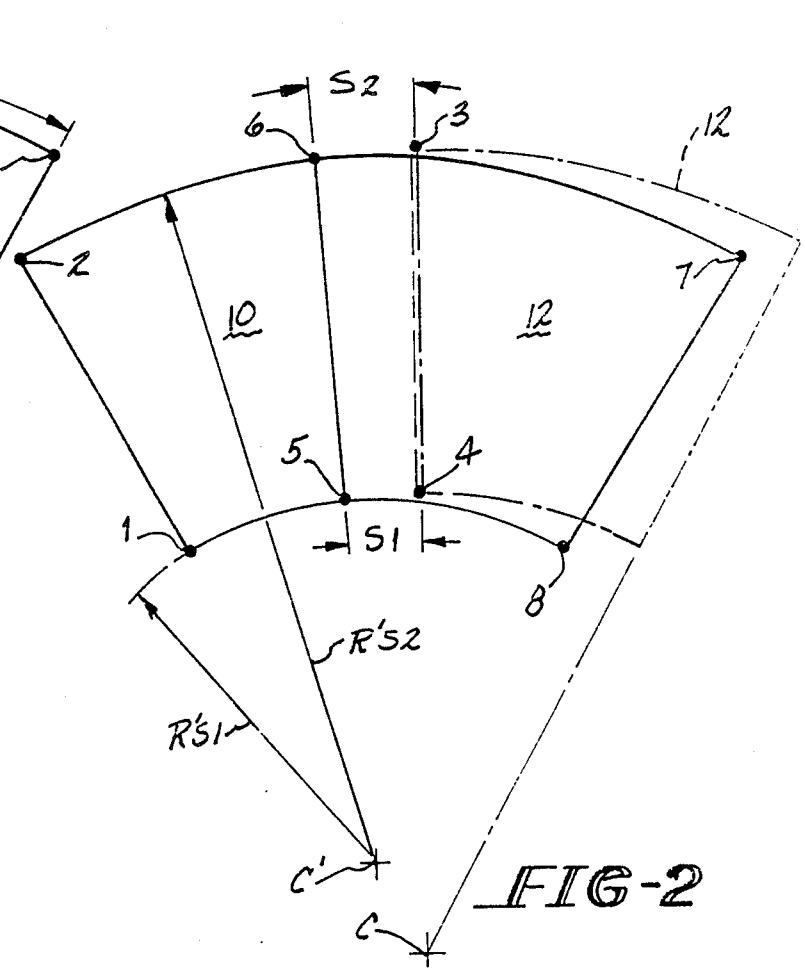
FIG. 2 is a plan view similar to FIG. 1 but showing the pivotal movement that the steps would undergo in the constant slope intermediate zone if the inner and outer step chains were kept at a constant effective length.

Referring to FIG. 2, the positions of the steps 10 and 12 are illustrated as they would appear in the intermediate constant slope incline zone of the escalator if the effective incremental lengths B1 and B2 of the inner and outer step chains were kept constant. The position of the step 12 in the landings is shown in FIG. 2 in phantom and the position of the step 12 in the incline is shown in solid lines. When the steps 10 and 12 are in the inclined zone of the escalator, assuming that step 12 is the higher step, it will have pivoted up and over the step 10 so that point 6 will have moved a distance S2 and point 5 will have moved a distance S1. This movement of the step 12 will cause the apparent radius of the inner side sections of the steps 10 and 12 to decrease to R'S1 and the apparent radius of the outer side sections of the steps 10 and 12 to decrease to R'S2 both of which will be struck from a center point C' which is offset from the original center point C.

Figures 3, 4, 5:
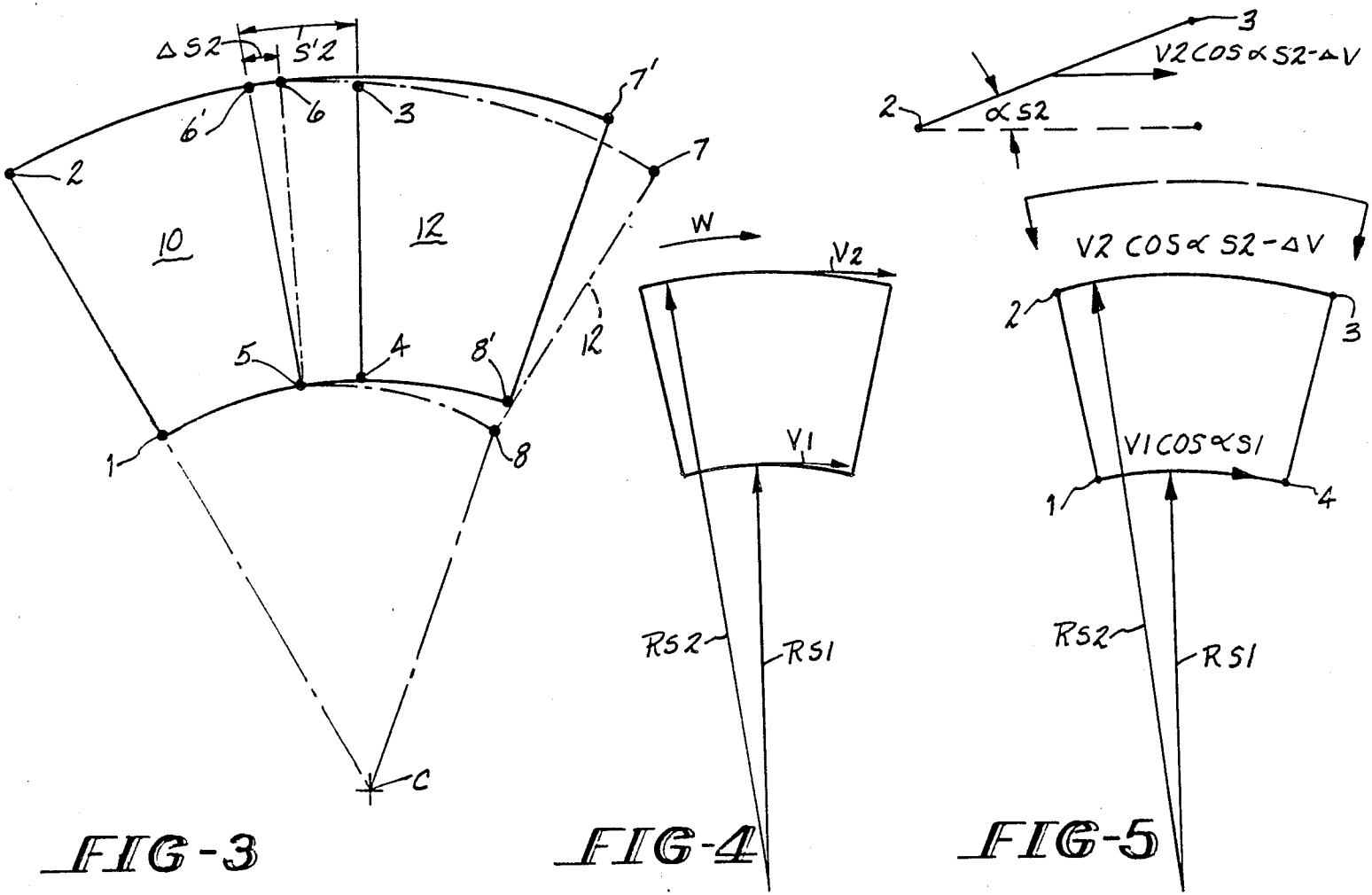
FIG. 3 is a plan view similar to FIG. 2, but showing the pivoted position of the steps in the intermediate zone when the effective length of the outside step chain is shortened while maintaining constant the effective length of the inside step chain.
FIGS. 4 and 5 are schematic views of the steps in the landing and inclined portions respectively showing how velocities can be related to step positions.

In order to counter this tendency of the steps 10 and 12 to spiral into a tighter radius path of travel, and to maintain the original radial path of travel, the step 12 must be pivoted an additional increment over the step 10 when the steps are in the intermediate inclined zone of the escalator path. In FIG. 3, the position of step 12 from FIG. 2 is shown in phantom, and the desired position needed to provide the constant radius is shown in solid lines. To achieve the desired position, the outside of the step 12 is further pivoted a distance ΔS2 so that the corners 6, 7 and 8 of the step 12 shift to positions 6', 7' and 8' respectively. The corner 5 of the step 12 can be considered as forming the pivot point and thus does not substantially shift its position. It will be appreciated that the radii described above are actually the step chain radii, but for purposes of explaining the step movement, they can be considered to be the radii of the path of movement of the inner and outer edges of the steps.

As noted, to make a constant plan radius curved escalator, the distance between point 2 and point 6 needs to get smaller while maintaining the distance between point 1 and point 5. A pivoting motion about point 5 is the result. This is done by shortening the length of the outer step chain as it goes through the entry transition zone. The result thereof is shown in FIG. 3.

The following equations can be used to calculate the required shortening of the outer step chain:

$$S1 = B1\,(1 - \cos\alpha s1) \qquad \text{eq. 1}$$

$$S2 = B2\,(1 - \cos\alpha s2) \qquad \text{eq. 2}$$

$$S'2 = \frac{Rs2}{Rs1}\,(S1) \qquad \text{eq. 3}$$

$$\Delta S2 = S'2 - S \qquad \text{eq. 4}$$

$$B'2 = \frac{B2 \cos \alpha\, s2 - \Delta S2}{\cos \alpha\, s2} \qquad \text{eq. 5}$$

where

Rs1=plan radius inner step track;
Rs2=plan radius outer step track;
B1=incremental chain length inner step;
B2=incremental chain length outer step;
B'2=incremental chain length outer in transition/incline section;
αs1=angle of inclination inner step track;
αs2=angle of inclination outer step track;
S1=arc length projection inner step;
S2=arc length projection outer step;
S'2=arc length projection outer step which will pivot the step onto the constant radius; and
ΔS2=delta arc length projection outer step which will pivot the step onto the constant radius.

VELOCITY

The following equations show how the velocities will be related to the step positions as shown in FIGS. 4 and 5, wherein:

V1=tangential velocity inner step edge;
V2=tangential velocity outer step edge;
W=angular velocity;
Rs1=plan radius inner step track;
Rs2=plan radius outer step track;
αs1=angle of inclination inner step track;
αs2=angle of inclination outer step track;
B1=incremental chain length inner step;
B2=incremental chain length outer step;
ΔS2=delta arc length projection outer step which will pivot the step onto the constant radius; and
ΔV=delta velocity subtracted from outer step in the plan view.

For the horizontal section which is shown in FIG. 4, the following equations apply.

$$V1 = W \times Rs1$$

$$1\ V2 = W \times Rs2$$

$$\frac{V1}{V2} = \frac{Rs1}{Rs2} = \text{constant} = K$$

$$\frac{Rs1}{Rs2} = \frac{B1}{B2}$$

For the transition section and incline section which is shown in FIG. 5, the following equations apply.

$$\frac{V1 \cos \alpha\, s1}{V2 \cos \alpha\, s2} \neq \frac{Rs1}{Rs2} = K$$

$$\frac{B1 \cos \alpha\, s1}{B2 \cos \alpha\, s2} \neq \frac{Rs1}{Rs2} = K$$

To vary the velocity of the outside step edge and vary the outside axle distance the following equations apply.

$$\frac{V1 \cos \alpha\, s1}{V2 \cos \alpha\, s2 - \Delta V} = \frac{Rs1}{Rs2} = \frac{B1 \cos \alpha\, s1}{B2 \cos \alpha\, s2 - \Delta S2}$$

whereupon ΔV can be calculated as follows:

$$\Delta V = V2 \cos \alpha\, s2 - \frac{Rs2}{Rs1}\,(V1 \cos \alpha\, s1).$$

Figure 6:
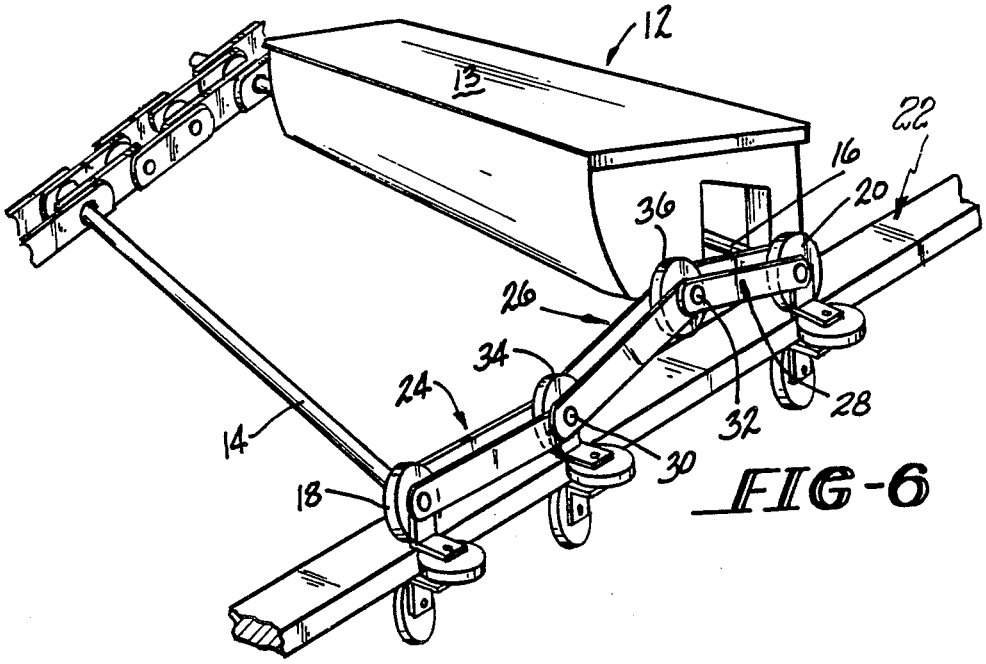
FIG. 6 is a perspective fragmented view of one embodiment of a step chain and track assembly formed in accordance with this invention.
Figure 7:
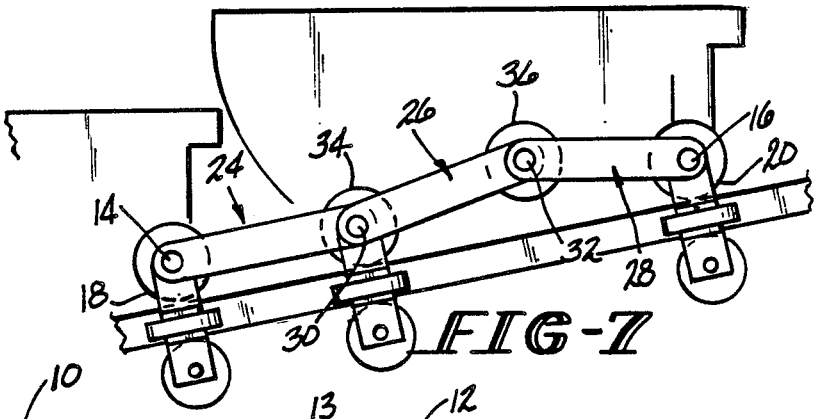
FIG. 7 is a side elevational view showing the assembly on the intermediate constant slope zone of the track illustrating how the effective length of the step chain is shortened.
Figure 8:
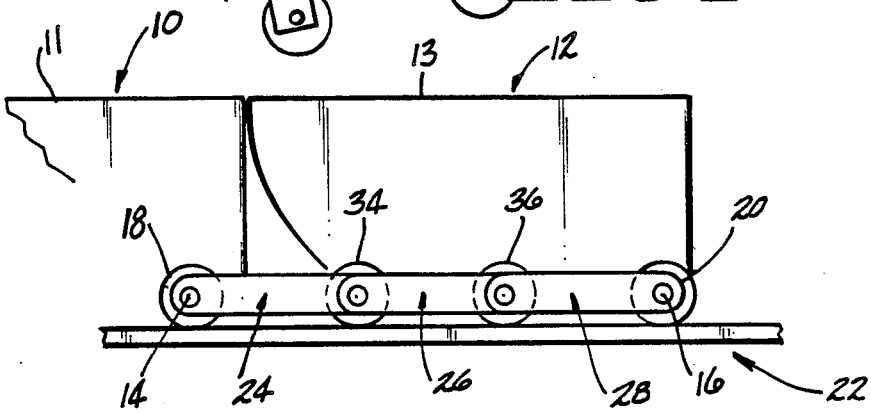
FIG. 8 is a side elevational view showing the assembly on a horizontal landing zone of the track illustrating how the effective length of the step chain is increased.
Figure 9:
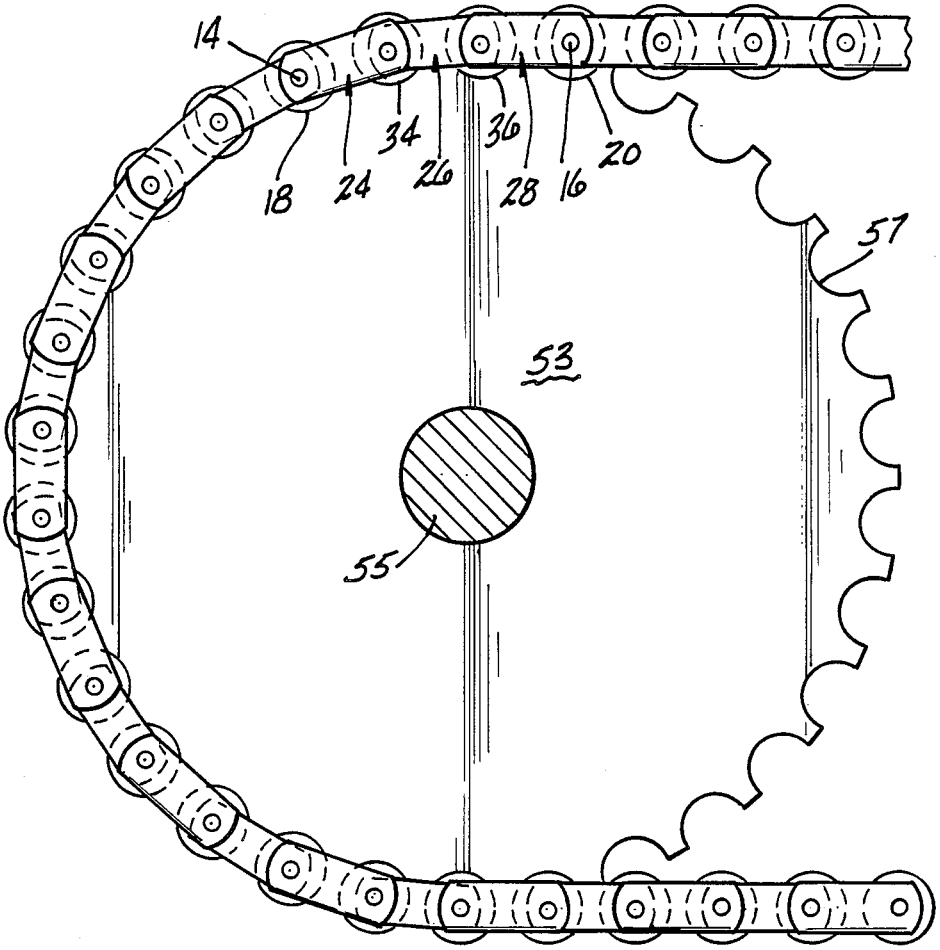
FIG. 9 is an elevational view of the turn around sprocket of the step chain of FIG. 6.

Referring now to FIGS. 6–10, there is shown an embodiment of an outer step chain and outer track which is operable to effect the aforesaid changes in the effective length of the outer step chain, and in the velocity of the outer side of the steps 10 and 12, which are shown schematically in FIG. 7 and 9. In FIG. 6 the step chain is shown as it appears on the intermediate constant slope portion of the escalator. What is shown is one segment of the step chain that interconnects adjacent step axles 14 and 16. The step axle 14 is mounted on the step 10 and the axle 16 is mounted on the step 12. The step axles 14 and 16 carry rollers 18 and 20 respectively which roll along the track 22. The chain segment shown includes three link sets 24, 26 and 28 which interconnect the step axles 14 and 16 respectively, and are also connected to rotation axles 30 and 32 of a pair of intermediate chain rollers 34 and 36. The intermediate chain roller axles 30 and 32 are also pivotally journaled to opposite ends of the chain link set 26.

The link set 28 is staked to the step axle 16 which, in turn, is fixed to the step 12. The link set 24, by contrast is rotatably journaled on the step axle 14 so that the step axle 14 can rotate in the link set 24 without affecting the latter. The rollers 18 and 20 are, of course, rotatably journaled on the axles 14 and 16. The securement of the link set 28 to the step axle 16 causes the link set 28 to remain parallel to the tread surface 13 on the step 12 no matter where the step 12 is along the path of travel of the escalator. Thus, in the constant slope portion of the path of travel of the escalator, the link set 28 will lift the chain roller 36 off of the track 22, as shown in Figs. 6 and 7, while the rollers 18 and 34 will continue to roll along the track 22. This causes the link sets 26 and 28 to become non-aligned thus forming a kink in the outer step chain. The step axles 14 and 16 are thus moved closer together in the constant slope zone of the path of travel of the escalator. By shortening the effective length of the outer step chain in this manner, the steps are properly realigned so that they will remain horizontal and will follow the tracks properly. The lifting of the roller 36 will occur gradually in the entry transition zone. In the horizontal landing zones shown in FIG. 8 the link sets 24, 26 and 28 are all aligned and parallel to the step treads 11 and 13, and all of the rollers 18, 20, 34 and 36 engage the track 22. It will be appreciated that when travelling from entry landing to exit landing, the step chain starts with a longer effective length which shortens in the entry transition zone, remains shortened in the constant slope zone, and then lengthens back to the original effective length in the exit transition zone. This shortening and lengthening of the distance between step axles is what properly positions the steps and keeps them travelling in a constant radius fixed center arcuate path, when viewed in plan.

As seen from FIG. 9, when the chain links 24, 26, 28 are all aligned in the horizontal landing zones, they will pass easily over the turn around sprocket 53 at the entry and exit of the escalator. The sprocket 53 is mounted on a driven shaft 55 and is disposed at one of the landing ends of the escalator. It will be appreciated that the escalator is thus of conventional construction wherein the return path of the steps lies beneath the passenger-carrying path. The sprocket 53 is formed with enlarged circumferential recesses 57 which are sized so as to receive and carry the rollers 18, 20, 34 and 36 of the driven step chain. It will be appreciated that there will be two reversing sprockets, one at each end of the escalator, but only one of which will be a drive sprocket. The other sprocket will be formed as shown but will serve as an idler sprocket which merely guides the chain but does not drive it.

It will be readily understood that the step chain and track assembly of this invention allows the escalator path of travel to be defined by a constant radius arc derived from a fixed center point. This in turn allows for greater control of step-to-step, and step-to-skirt gaps in the escalator. Balustrades, tracks and skirts can be more easily formed and accurately installed. Additionally, the step pivoting feature of the invention assures a relatively simple mechanical form which eliminates the complex step connections described in the aforesaid prior art. The movement of the steps is completely controlled at all points in the path of travel of the escalator, and may be customized to accommodate different sweep angles, angles of inclination, and rise distances for the escalator.

It will be appreciated that the adjustments in effective chain lengths will preferably be made in the outer step chain.

Since many changes and variations of the disclosed embodiments of the invention may be made without departing from the inventive concept, it is not intended to limit the invention otherwise than as required by the appended claims.

We claim:

1. An escalator assembly having an arcuate path of travel defined by a constant radius derived from a fixed center as viewed in plan, the escalator including horizontal entry and exit landing zones, an intermediate constant slope zone, and entry and exit transition zones of continuously varying slope interconnecting the constant slope zone with the entry and exit landing zones respectively, said escalator having turn around sprockets at each of said landing zones for reversing the direction of travel of the moving escalator components and said escalator assembly including:

(a) radially inner and outer tracks extending between said landing zones and through said transition and constant slope zones for guiding movement of steps along the path of travel of the escalator;

(b) a plurality of steps, each having: an upper tread which remains substantially horizontal throughout a passenger transporting portion of the path of travel of the escalator; a step axle at radially inner and outer sides of each step; radially inner and outer step axle rollers rotatably mounted on said step axles, said step axle rollers being operable to travel over said inner and outer tracks; and (c) a radially outer step chain forming a continuous connection between radially outer ends of said step axles whereby all of said steps are connected together by the outer step chain at their outer sides throughout the entire path of travel of the escalator, said outer step chain including step axle links which are rigidly fixed to said outer side step axles of each step so as to maintain a constant angular relationship to said step tread throughout the entire path of travel of the escalator; and a plurality of intermediate links connecting said step axle links to the next adjacent outer side step axle on the escalator, said intermediate links being pivotally connected to each other; to said step axle links; and to said next adjacent step axle to form a flexible connection between each step axle link and the next adjacent step axle connected to the outer step chain, said step axle links, by reason of their being rigidly fixed to said outer step axles, being operable to shorten the effective length of said outer step chain by forming kinks in said intermediate links in the transition and constant slope zones of the escalator.

2. The escalator assembly of claim 1 further comprising step chain rollers mounted at each pivotal connection between said intermediate links and between intermediate links and said step axle links, said rollers being operable to travel over said outer track, and wherein the step chain rollers which are mounted on said step axle links are lifted upwardly away from said outer track in said transition and constant slope zones.

3. The escalator assembly of claim 2 wherein said step axle links are parallel to said step treads.

4. The escalator assembly of claim 3 wherein said step chain rollers which are mounted on said step axle links contact said outer track in said landing zones.

5. The escalator assembly of claim 1 wherein said step axle links and said intermediate links are all parallel to said step treads in said landing zones.

* * * * *